United States Patent [19]

Wood, II

[11] Patent Number: 4,832,210

[45] Date of Patent: May 23, 1989

[54] BOAT LIFT

[76] Inventor: Donald M. Wood, II, 3191 Waaler St., Stuart, Fla. 33497

[21] Appl. No.: 155,915

[22] Filed: Feb. 16, 1988

[51] Int. Cl.[4] ..... B63B 23/02

[52] U.S. Cl. ..... 212/200; 114/368; 405/2; 405/3

[58] Field of Search ..... 114/365, 368, 369, 375, 114/44, 45, 48; 212/199, 200, 267, 269; 405/1-3; 187/14, 12, 95; 414/595, 678

[56] References Cited

U.S. PATENT DOCUMENTS

| | | | |
|---|---|---|---|
| 1,868,043 | 7/1932 | Barclay | 114/369 |
| 2,211,088 | 8/1940 | Arnold | 212/199 |
| 3,675,258 | 7/1972 | Osmundson | 114/368 |
| 3,778,855 | 12/1973 | Kariagn et al. | 114/368 |
| 3,837,502 | 9/1974 | Hornagold | 405/3 |
| 4,337,868 | 7/1982 | Gattu | 212/267 |
| 4,641,996 | 2/1987 | Seal | 405/3 |

*Primary Examiner*—Sherman D. Basinger
*Assistant Examiner*—Stephen P. Avila
*Attorney, Agent, or Firm*—Malin, Haley & McHale

[57] ABSTRACT

A boat lift assembly wherein the use of a conventional cable system has been replaced with a screw drive assembly. The screw drive assembly eliminates all the safety hazards which accompany a cable operated system. Additionally, the use of aluminum components is extensive throughout to keep corrosion to a minimum. Further, Teflon and Lexan wear strips are used to eliminate friction problems between the relatively moving members.

5 Claims, 3 Drawing Sheets

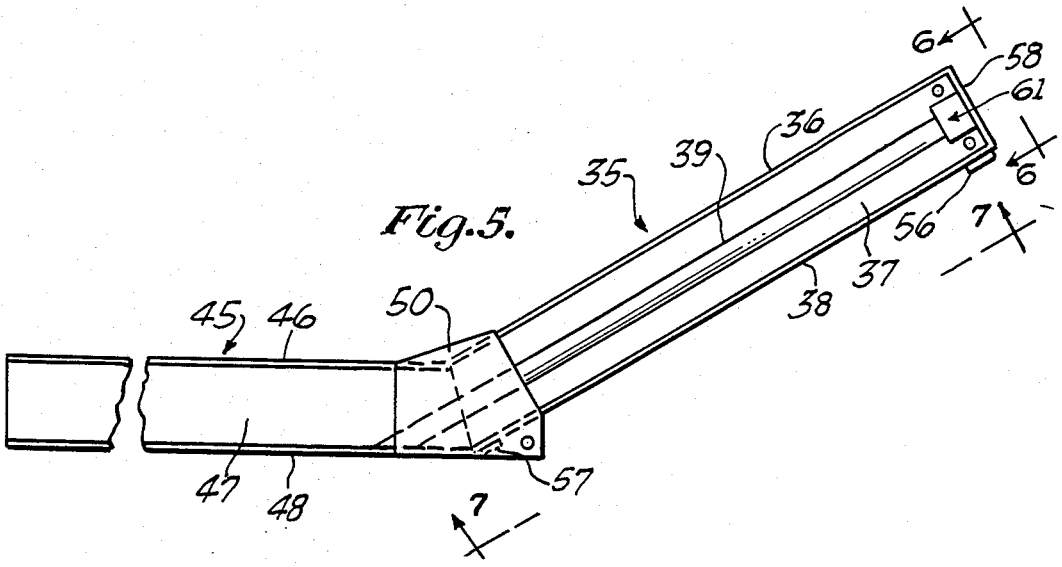
Fig.5.
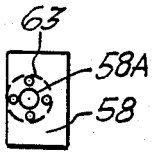
Fig.6.
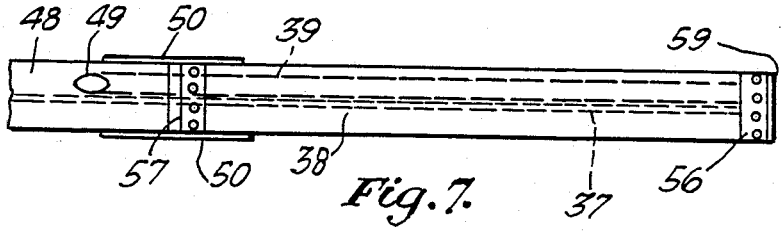
Fig.7.
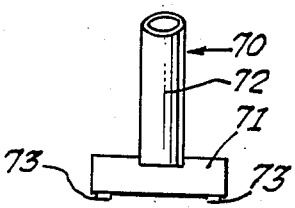
Fig.8.
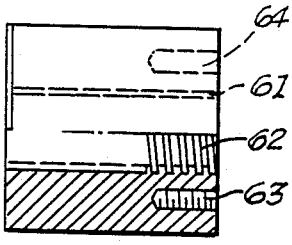
Fig.9.
Fig.10.
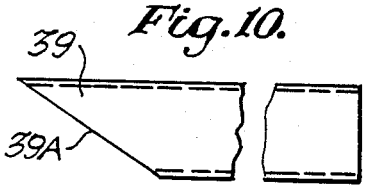
Fig. 11.
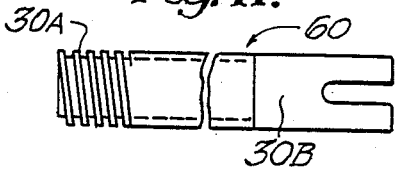

BOAT LIFT

BACKGROUND OF THE INVENTION

The invention relates generally to boat lifts and more specifically to a permanently mounted boat lift which can be used to lower a boat into the water or raise a boat from the water to permit inspection and/or maintenance or just to temporarily support the boat while not in use. There are presently a variety of such devices available on the open market. Most of the known devices utilize cables to pull the boat from the water or to place it in the water. The use of cables as the raising or lowering means presents several safety hazards. For example, if a cable were to snap, there is the potential for serious injury to someone in close proximity at the time of breakage due to the "whipping" of the cable produced by the tension that the cable is undergoing. Another potential problem with cables is the fact that as the cable is paying out or being withdrawn, a person near the cable could become entwined with the cable and cause serious injury. A further problem with cables is the fact that the cable will stretch thus requiring frequent adjustment.

SUMMARY OF THE INVENTION

The present invention has been designed with the above noted problems in mind. In order to overcome the many problems encountered when using cables, applicant has developed a screw driven system. An electric motor drives a worm gear assembly which is operatively connected to a transport screw and transport carrier. The transport carrier is fixedly secured to the lifter assembly which rides up and down on the guide rail assembly. To reduce the potential for injury to a minimum, the transport screw is enclosed in a transport screw guide for the full length of the lifter rail. Thus making it very difficult for someone's clothes to become wrapped about the transport screw.

Additionally, the lifter rail has been provided with wear strips made of Teflon to reduce friction between the lifter rail and the guide rail assembly. Thus providing a smooth movement of the boat and lifter assembly as it travels up and down the guide rail assembly.

OBJECTS OF THE INVENTION

An object of the invention is to provide a boat lifting mechanism which possesses superior safety features over known devices.

Another object of the invention is the provision of a boat lifting mechanism which utilizes a screwdrive assembly.

A further object of the invention is the provision of a boat lifting mechanism utilizing components which are highly resistant to corrosion.

Yet another object of the invention is to provide a boat lifting assembly which is made of lightweight materials and easily assembled.

A still further object of the invention is the provision of a boat lifting mechanism utilizing a pair of identical spaced lifting assemblies which are anchored at their upper and lower ends.

Another object of the invention is to provide a boat lifting mechanism which is provided with friction reducing means between the lift and guide rail assemblies.

These and other objects of the invention will become more apparent hereinafter. The instant invention will now be described with particular reference to the accompanying drawings which form a part of this specification wherein like reference characters designate the corresponding parts in the several views.

BRIEF DESCRIPTION OF THE DRAWINGS

FIG. 5 is a detailed illustration of the lifter assembly per se.

FIG. 6 is a view taken on the plane 6—6 of FIG. 5.

FIG. 7 is a bottom view of the lifter assembly taken on the plane 7—7 of FIG. 5.

FIG. 8 is an illustration of the stanchion mounting assembly taken on the plane 8—8 of FIG. 1.

FIG. 9 is an illustration of the transport carrier per se.

FIG. 10 is an illustration of the transport screw guide per se.

FIG. 11 is an illustration of the transport screw per se.

DETAILED DESCRIPTION OF THE DRAWINGS

Figure 1:
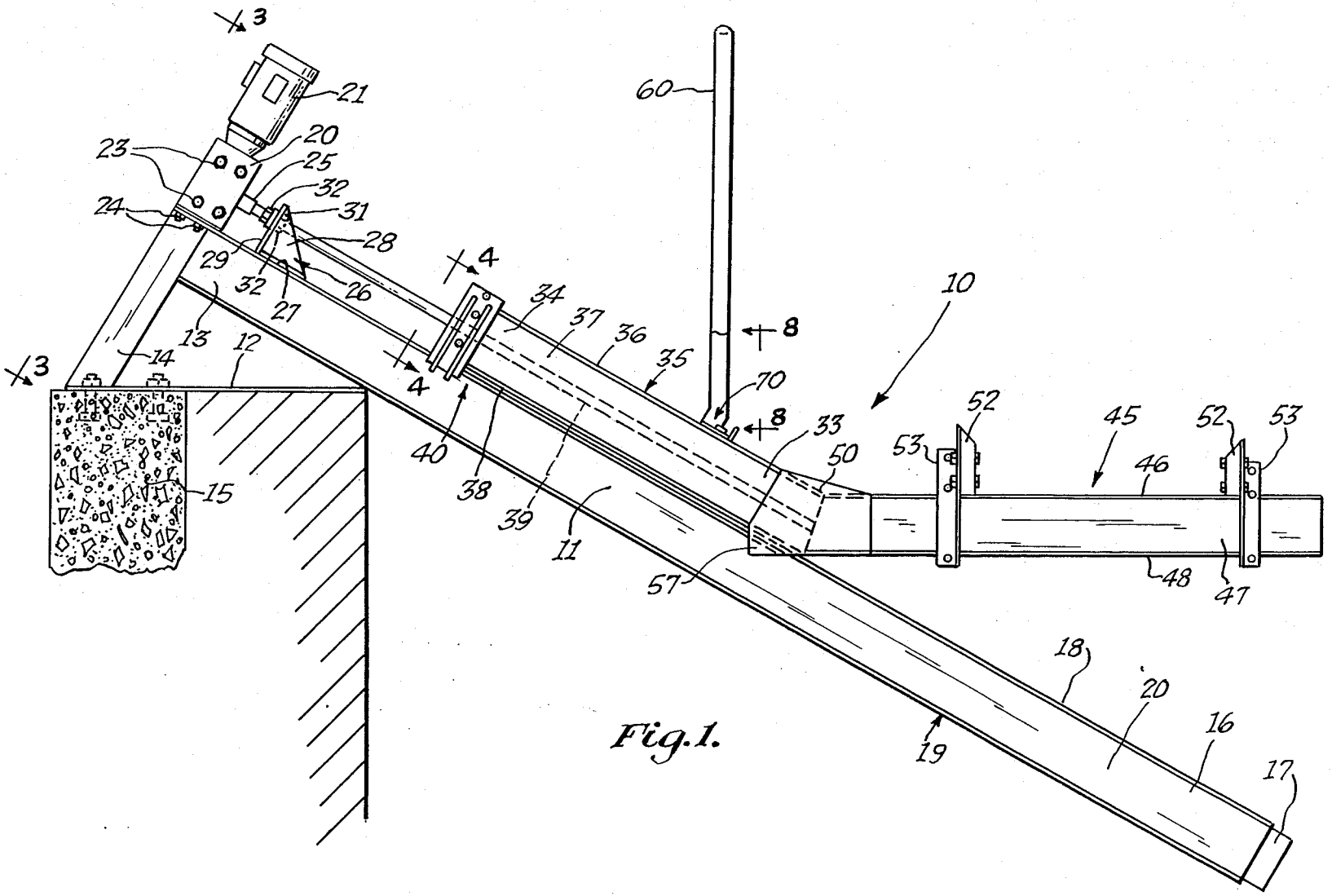
FIG. 1 is an end view looking at the boat lifting assembly mounted at its upper end on a concrete footing.
Figure 2:
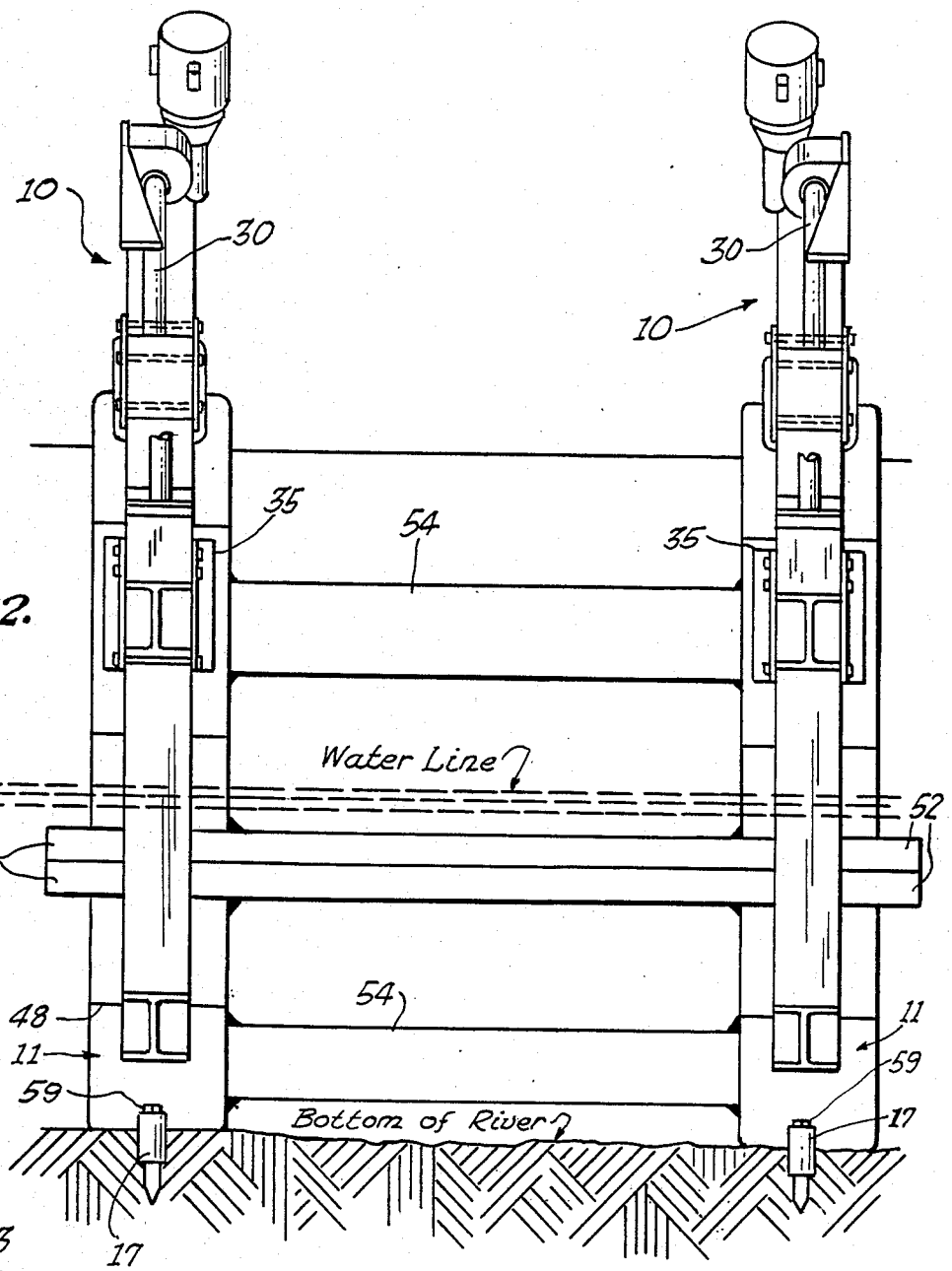
FIG. 2 is a schematic showing of a pair of lift assemblies with securing bracing therebetween.

Referring now to FIG. 1, there is shown one-half of the boat lift assembly generally indicated by the reference numeral 10. The lift assembly 10 comprises a guide rail 11 which extends at an angle from the base plate 12 where it is anchored at its upper end 13 by means of support 14 where base plate 12 is bolted to concrete footing 15. Guide rail 11 is an aluminum I-beam to resist corrosion. The lower end 16 of guide rail 11 is provided with an anchor tube 17 which receives an anchoring stake (FIG. 2). As indicated earlier, guide rail is an I-beam having an upper flanged portion 18 and a lower flanged portion 19 interconnected by a central web 20.

Upper end 13 of guide rail 11 provides the supporting surface for worm gear mounting assembly 20 which is mounted on upper flange 18 by bolts 24. Wormgear mounting assembly 20 provides support for motor 21 and wormgear assembly 22 which is coupled to the housing of motor 21. Both motor 21 and wormgear assembly 22 are supported by wormgear mounting assembly 20 by a plurality of bolts 23. Projecting from wormgear assembly 22 is output shaft 24 which is provided with coupling 25. Immediately below coupling 25 is the thrust bearing mounting bracket 26 which is fixedly secured to upper flange 18 of guide rail 11. Mounting bracket 26 is provided with a base plate 27 which is attached to upper flange 18. Mounting bracket 26 also includes a pair of triangular gusset plates 28 which are attached to a vertically positioned thrust plate 29. Thrust plate 29 is provided with an offset aperture (not shown) through which transport screw 30 extends. On opposite sides of thrust plate 29 are a pair of thrust bearings 31 and outboard of each thrust bearing 31 is a thrust bearing adjuster nut 32.

The reason for offsetting the aperture in thrust plate 29 is to take the aperture out of alignment with web 37 of slider rail 35. Mounted on back side of web 37 is transport screw guide 39 which extends the full length of slider rail 35 and terminates in elongated opening 49 in the lower flange 48 of lifter beam 45 as shown in FIG. 7.

Upper end 34 of slider rail 35 is provided with a retainer assembly 40 which serves to clamp slider rail 35 to guide rail 11. The details of retainer assembly 40 will be discussed later in the discussion of FIG. 4. As indicated above, the lower end 33 of slider rail 35 is interconnected with lifter beam 45. A pair of reinforcement plates 50 are welded on opposite sides of the joint where lifter beam 45 abuts slider rail 35. It is to be noted that corner 51 of reinforcement plate 50 overlaps lower flanges 38 and 48 and also upper flange 18 of guide rail 11. The overlapping of corners 51 on each side of upper flange 18 provides lateral stability to the slider rail 35 and lifter beam 50 as they move up and down guide rail 11. Positioned on upper flange 36 is stanchion mounting assembly 70 for guide marker 60.

Lifter beam 45 is permanently attached to slider rail 35 in such a manner as to ensure that upper flange 46 and lifter beam 45 present a horizontal planar surface. Upper flange 46 provides supporting surface for runners 52 which form the bunk assembly for the hull of the boat to be supported thereby. Runners 52 extend axially and are interconnected with the other lifter beam 45 spaced a given distance therefrom. As illustrated each runner 52 is secured to lifter beam 45 by a pair of bunker clamps 53, with one on each side of lifter beam 45. Bolts are used to interconnect each pair of bunker clamps 53 as are additional bolts used to secure the first end of each runner 52 to their respective bunker clamps 53.

Referring now to FIG. 2, there is shown a schematic illustration of a pair of lifter beams 45 and slider rails 35 mounted on their respective guide rails 11 in spaced relation to each other. The distance between each of the lifter assemblies is determined by the length of the boat which is to be raised or lowered. As shown, the lifter assemblies are permanently mounted and anchored at the top and bottom of guide rail 11. Although only two lifter assemblies 10 are shown, it is conceivable that the size of the boat may require a third such unit. Additionally, appropriate bracing beams 54 serve to provide additional stability to the lifter assemblies 10 as indicated. At the lowermost end of guide rail 11 a pair of anchoring stakes 59 are driven through anchor 17 into the bed of the body of water.

Figure 3:
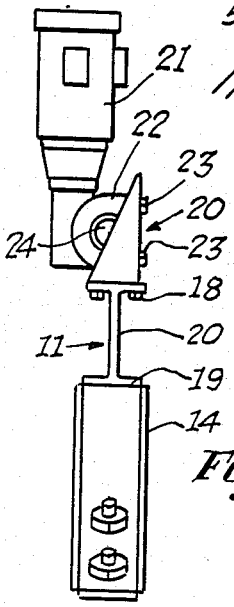
FIG. 3 is a view taken on the plane 3—3 of FIG. 1 illustrating the mounting of the motor end gear assembly.

Referring now to FIG. 3, there is shown an end view taken on the plane 3—3 of FIG. 1 looking in the direction of the arrows. FIG. 3 is a clear illustration of wormgear mounting assembly 20 as it supports wormgear assembly 21 and motor 21. Support 14 is shown as supporting upper end 13 of guide rail 11. Appropriate welds are used to secure guide rail 11 to the upper end of support 11 with the lower end of support 11 secured to base plate 12 which is bolted to concrete footing 15.

Figure 4:
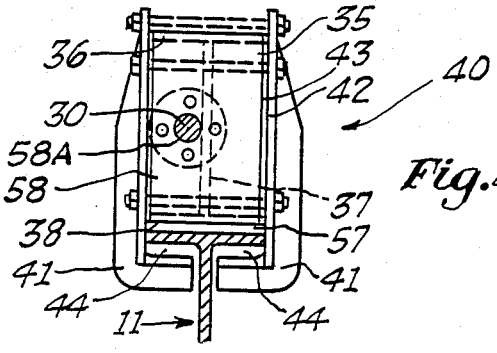
FIG. 4 is a sectional view taken along the plane 4—4 of FIG. 1 illustrating the retainer assembly for the lifter.

Referring now to FIG. 4, there is shown a sectional view taken on the plane 4—4 of FIG. 1. FIG. 4 is a detailed showing of the components of retainer assembly 40. Each half of the retainer assembly 40 comprises a pair of stiffeners 41 which are J-shaped. Each pair of stiffeners 41 is provided with side plate 42 attached to the vertical leg of the J and a bottom plate 42A attached to the shorter leg of the J. Positioned inward of each side plate 42 is a spacer 43 which engages the side edge of upper flange 36 and lower flange 38. Positioned on top of bottom plate 42A is a Teflon wear strip 44 which engages the underside of upper flange 18 of guide rail 11. Positioned on the underside of lower flange 38 is a Lexan wear strip 57 which serves to keep slider rail 35 from coming into direct contact with guide rail 11. As is well known, Lexan and Teflon are tough materials which possess lubricating qualities and as such reduce the friction generated when moving slider rail up or down along guide rail 11.

The purpose of spacer 43 inside side plate 42 is to make certain that the lower portion of the side plate 42 will not come into contact with upper flange 18 of guide rail 11. End plate 58 is shown as being welded to the end of slider rail 35 with transport screw 30 to the left of web 37. Further, transport screw 30 is shown extending through end plate 58. A plurality of bolts are used to clamp side plates 42 and stiffeners 41 into a retainer assembly 40.

Referring now to FIG. 5, there is shown a detailed view of slider rail 35 and lifter beam 45 attached to each other by reinforcement plates 50, (one on each side). At the uppermost end of transport screw guide 39 is transport carrier 61 which was welded in place prior to the placing of end plate 58 thereover. Lexan wear strip 57 at the lower end of slider rail 35 and Teflon wear strip 56 at the upper end of slider rail 35 are also clearly shown.

FIG. 6 is an end view of FIG. 6 as indicated by the plane 6—6 of FIG. 5 illustrating the offset of bore 58A to bring transport screw 30 to the left side of web 37 of slider rail 35.

Referring now to FIG. 7, which is a view taken along the plane 7—7 of FIG. 5 looking in the direction of the arrows. FIG. 7 clearly illustrates the joint between slider rail 35 and lifter beams 45 and their attachment by reinforcement plates 50. In addition, welds are placed as necessary to provide the necessary strength. Elongated opening 49 is shown in lower flange 48 of lifter beam 45 and provides the required opening for transport screw 30 as slider rail 35 moves up guide rail 11.

FIG. 8 is a detail view of stanchion mounting assembly 70 which comprises a base portion 71 which has cylindrical extension 72 welded thereto at an angle to permit the marker 60 (FIG. 1) to be vertical when inserted therein. Tabs 73 project downward from the bottom of base 71 and are received in a pair of apertures in upper flange 36 of slider rail 35. The tabs 73 prevent rotation of stanchion assembly 70 in the event it is hit by a boat while docking.

Referring now to FIG. 9, there is shown a detail view of transport carrier 61. Transport carrier 61 is provided with internal threads 62 which are compatible with the external threads of transport screw 30. The upper end face 63 of transport carrier 61 is provided with four threaded bores 64 for receiving bolts after transport carrier 61 is mounted on slider rail 35 and end plate 58 is placed thereover. Carrier 61 is the element which converts the rotary motion of screw 30 to longitudinal motion of slider rail 35.

FIG. 10 is an illustration of transport screw guide 38 through which transport screw 30 extends after transport screw guide 39 has been secured (welded) to web 37 of slider rail 35. The tapered end 39A provides a flush surface as guide 39 meets bottom flange 48 of lifter beam 45.

Referring now to FIG. 11, there is shown a detail of transport screw 30 which is provided with threads 30A along its entire length except for the uppermost end 30B which is received in coupling 25.

As shown in FIG. 2 there are two lift assemblies 10 each with their own motor, thus the motors are wired in such a manner that both motors 21 will be simultaneously controlled by a single control.

While the invention has been described in its preferred embodiment, it is to be understood that the words which have been used are words of description rather than limitation and that changes may be made within the purview of the appended claims without departing from the full scope or spirit of the invention.

Having thus described my invention; I claim:

1. A lift mechanism comprising in combination support means fixedly anchored adjacent a seawall; guide rail means having a first and second end and supported by said support means at said first end thereof; said guide rail means extending at an angle from said support means into a body of water retained by said seawall and anchored at said second end into the bed of the body of water; slider rail means having a first and second end and positioned in parallel relation to said guide rail means, guide means secured to said first and second ends of said slider rail means for slideably guiding said slider rail means relative to said guide rail means; friction reducing means positioned between said slider rail means and said guide rail means; lifter beam means angularly secured to said slider rail means at said second end of said slider rail means; said lifter beam means presenting a horizontal supporting surface; bunk means fixedly attached to said lifter beam means and screwdrive means operatively connected to said slider rail means whereby actuation of said screwdrive means will raise or lower said slider rail means, said lift beam means and said bunk means depending upon the direction of rotation of said screwdrive means; said guide means at said first end of said slider rail means including a pair of J-clamps having a short leg and a long leg with said long leg fixedly secured to opposite sides of said slider rail means and said short leg extending under a portion of said guide rail means; said friction reducing means including friction reducing wear strips attached to said first and second end of said slider rail means and also said short leg of said J-clamp to prevent metal to metal contact between said guide rail means and said slider means and also said J-clamps; said guide means further includes spacer means attached to the inner face of said long legs of said J-clamps to prevent said J-clamps from making metal to metal contact with said guide rail means; said screwdrive means including motor means operatively connected to a worm gear assembly the output of which is a rotary transport screw; thrust bearing means supporting said transport screw and transport carrier means attached to said upper end of said slider rail means; said screwdrive means further includes a transport screw guide; said transport screw guide being fixedly attached to said slider rail means in offset relation thereto and enclosing said transport screw along the entire length of said slider rail means; said thrust bearing means includes a supporting member fixedly attached to said first end of said guide rail means, a pair or thrust bearings mounted on said transport screw on opposite sides of said supporting member and a pair of adjuster nuts mounted on said transport screw outboard of said pair of thrust bearings; said transport carrier means converts the rotary motion of said rotary transport screw into longitudinal movement of said slider rail means and said lifter beam means.

2. A lift mechanism as definded in claim 1 wherein said guide rail means, said slider rail means and said lifter beam means each comprise an aluminum I-beam which is highly resistant to corrosion.

3. A lift mechanism as defined in claim 1 wherein said guide means at said second end of said lifter rail means comprises a pair of side plates secured at the juncture of said slider rail means and said lifter beam means; said side plates securely attached to said slider rail means and said lifter beam means with a portion of said side plates overlapping said guide rail means and preventing lateral displacement of said slider rail means and said lifter beam means relative to said guide rail means.

4. A lift mechanism as defined in claim 1 wherein there is provided a second guide rail means, slider rail means, lifter beam means, and screwdrive means in spaced relation to said first mentioned guide rail means, slider rail means, lifter beam means and screwdrive means with said bunk means comprising a pair of interconnecting supports for supporting an object thereon and control means for simultaneously actuating both said screwdrive means.

5. A lift mechanism as defined in claim 1 wherein said lifter means includes adjustable runner means connected to said lifter means, said runner means adjustable in general vertical movement to cradle a boat on the lifter means.

* * * * *